US006229410B1

(12) United States Patent
Lee et al.

(10) Patent No.: US 6,229,410 B1
(45) Date of Patent: May 8, 2001

(54) INTEGRAL DIELECTRIC FILTER

(75) Inventors: Su Kil Lee; Sung Hwan Park, both of Kyungki-do; Hong Seok Lee, Seoul, all of (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 09/332,267

(22) Filed: Jun. 11, 1999

(30) Foreign Application Priority Data

Dec. 21, 1998 (KR) ..... 98-56815

(51) Int. Cl.[7] ..... H01P 1/202; H01P 1/205
(52) U.S. Cl. ..... 333/206; 333/202
(58) Field of Search ..... 333/206, 222, 333/207, 223, 202 DB

(56) References Cited

U.S. PATENT DOCUMENTS

| | | | | |
|---|---|---|---|---|
| 5,327,108 | | 7/1994 | Hoang et al. | 333/203 |
| 5,436,602 | * | 7/1995 | McVeety et al. | 333/206 |
| 5,721,520 | * | 2/1998 | McVeety et al. | 333/202 |
| 5,850,168 | | 12/1998 | McVeety et al. | 333/207 |
| 5,977,848 | * | 11/1999 | Nakaguchi et al. | 333/206 |

* cited by examiner

*Primary Examiner*—Benny Lee
*Assistant Examiner*—Stephen E. Jones
(74) *Attorney, Agent, or Firm*—Renner, Otto, Boisselle & Sklar LLP

(57) ABSTRACT

An integral type dielectric filter is disclosed, in which the insertion loss is minimized, and the damping characteristics desired by the user are satisfied. The dielectric filter includes a dielectric block having first and second faces facing toward each other and having a plurality of side faces. A ground electrode is coated on the entire faces of the dielectric block except the first face. A plurality of through holes pass through the first and second faces, with their surfaces being coated with a conductive material. Input and output electrodes are formed on a face of the dielectric block insulatingly from the ground electrode, for forming an electromagnetic coupling with internal electrodes of the plurality of the through holes. At least one metallic coupling region is formed between the input and output electrodes and between the through holes of the first face insulatingly from the ground electrode and from the input and output electrodes to form a capacitive coupling between the input and output electrodes and the through holes. Thus the insertion loss can be decreased compared with the conventional techniques, while improving the damping rate. Further, at least a non-metallic coupling region is formed to realize an inductive coupling, and thus the damping characteristics can be improved at the high frequency side.

19 Claims, 15 Drawing Sheets

INTEGRAL DIELECTRIC FILTER

BACKGROUND OF THE INVENTION

1. Field of the Invention

The present invention relates to an integral type dielectric filter which removes noises or adjacent channel signals from a signal stream in a portable communication apparatus. Particularly, the present invention relates to an integral type dielectric filter in which the insertion loss is minimized, and the damping characteristics desired by the user are satisfied.

2. Description of the Prior Art

Recently, various portable communication apparatuses are flooded. In the midst of this flooding, users want portable communication apparatuses which do not just have communication functions, but also are cheaper and more miniaturized so as to make it more convenient to carry with them. To cater to this trend, manufacturers are producing portable communication apparatuses of small volume and light weight.

As a conventional dielectric filter, there is U.S. Pat. No. 5,537,082 as illustrated in FIG. 1*a*. In this filter, two through holes 101 and 102 are formed side by side in a dielectric block, and a conductive electrode is formed on the entire surface of the dielectric block. On an upper face 300 which is parallel with the through holes 101 and 102, there are formed input/output electrodes 301 and 302. The conductive electrode of the first face 100 is removed, and a non-metallic coupling region 201 is formed on a second face 200 (which is lying opposite to the first face 100) between the through holes 101 and 102 by regionally removing the conductive electrode. Thus a capacitance coupling is formed between the through holes 101 and 102 which serve as resonators.

This dielectric filter is a capacitance coupling filter which has pass characteristics over the low frequency bands. In this dielectric filter, if a damping characteristic of −30 dB or less is to be satisfied at a low frequency band (about 903 MHz) as desired by users, the pass band shows a damping of −4.0 dB as illustrated in FIG. 1*b*, with the result that the insertion loss is aggravated.

Japanese Patent Laid-open Gazette No. Hei-10-126107 discloses another structure of the dielectric filter as shown in FIG. 2*a*. In this dielectric filter, a conductive electrode is formed on the entire surface of the dielectric block in which through holes 101 and 102 are formed. Further, non-metallic regions 101*a* and 102*a* are formed respectively within the through holes 101 and 102 by removing the conductive materials, thereby forming an electrical coupling between the through holes 101 and 102.

In this dielectric filter, the insertion loss at the mean frequency (about 927 MHz) is −2.5 dB, and thus its insertion loss is lower than that of the dielectric filter of FIG. 1*a*. At the damping point (about 903 MHz or about 949 MHz), however, a maximum damping characteristic of −19 dB is seen. Thus, if a satisfactory damping characteristic of −30 dB or less is to be obtained, the insertion loss is aggravated up to −4.0 dB.

Further, conventionally in order to satisfy the damping characteristics, the insertion loss has to be allowed to be increased as described above. However, in view of the price competitions between the manufacturers and the limitation of the frequency resources, there is a demand for a dielectric filter which is accompanied by a low manufacturing cost and shows a superior damping characteristic.

SUMMARY OF THE INVENTION

The present invention is intended to overcome the above described disadvantages of the conventional techniques.

Therefore it is an object of the present invention to provide an integral type dielectric filter in which the insertion loss is decreased, but the damping characteristics are improved.

In achieving the above object, the integral type dielectric filter according to the present invention includes: a dielectric block having first and second faces facing toward each other and having a plurality of side faces; a ground electrode coated on the entire faces of the dielectric block except the first face; a plurality of through holes passing through the first and second faces, with their surfaces being coated with a conductive material; input and output electrodes formed on a face of the dielectric block insulatingly from the ground electrode, for forming an electromagnetic coupling with internal electrodes of the plurality of the through holes; and at least one metallic coupling region formed between the input and output electrodes and between the through holes of the first face insulatingly from the ground electrode and from the input and output electrodes to form a capacitive coupling between the input and output electrodes and the through holes, whereby the integral type dielectric filter as a band pass filter can improve the damping rate at a low frequency side.

Or the integral type dielectric filter according to the present invention includes a non-metallic coupling region formed on a side face, for forming an inductive coupling between the through holes, whereby the integral type dielectric filter as a band pass filter can improve a damping rate at a high frequency side.

In another aspect of the present invention, the integral type dielectric filter according to the present invention includes: a dielectric block having first and second faces facing toward each other and having a plurality of side faces; a ground electrode coated on the entire faces of the dielectric block except the first face; a plurality of through holes passing through the first and second faces, with their surfaces being coated with a conductive material; input and output electrodes formed on a face of the dielectric block insulatingly from the ground electrode, for forming an electromagnetic coupling with internal electrodes of the plurality of the through holes; at least one metallic coupling region formed between the input and output electrodes and between the through holes of the first face insulatingly from the ground electrode and from the input and output electrodes to form a capacitive coupling between the input and output electrodes and the through holes; at least a non-metallic coupling region formed on a side face of the dielectric block with the shape of a closed loop; and at least one metallic region insulated from the ground electrode by forming a non-metallic coupling region.

In still another aspect of the present invention, the integral type dielectric filter according to the present invention includes: a dielectric block having first and second faces facing toward each other and having a plurality of side faces; a ground electrode coated on the entire faces of the dielectric block except the first face; a plurality of through holes passing through the first and second faces, with their surfaces being coated with a conductive material; input and output electrodes formed on a face of the dielectric block insulatingly from the ground electrode, for forming an electromagnetic coupling with internal electrodes of the plurality of the through holes; and at least one non-metallic coupling region formed along an arrangement direction of the plurality of the through holes, for forming an inductive coupling between the plurality of the through holes.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

First the integral type dielectric filter according to the present invention (which is used as a band pass filter) will be roughly described. Catering to the diversified needs of users, the dielectric filter decreases the insertion loss at the mean frequency, while improving the damping rate at the low frequency side of the pass band. When the damping rate is to be decreased at the low frequency side of the pass band, there is formed a metallic coupling region which extends from between through-holes to between input and output electrodes, and which is not electrically connected to another electrode (ground electrode), thereby increasing the capacitive coupling. On the other hand, when the damping rate is to be decreased at the high frequency side of the pass band, there is formed a non-metallic coupling region at a side face portion remote from the first face, thereby reinforcing the inductive coupling. The constitution and action of the dielectric filter according to the present invention will be described in detail below.

Figure 3A:
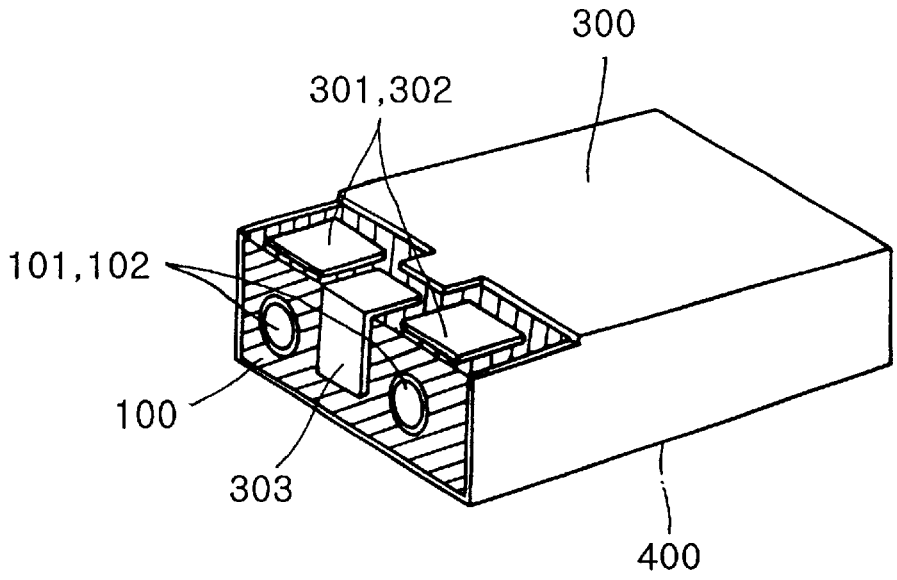
FIG. 3*a* is a perspective view showing one embodiment of the integral type dielectric filter according to the present invention.

FIG. 3*a* is a perspective view showing one embodiment of the integral type dielectric filter according to the present invention. A conductive electrode is formed on the entire surface of the dielectric block which has through holes 101 and 102. A part of the electrode of a third face 300 which is parallel to the through holes 101 and 102 is removed to form input and output electrodes 301 and 302. Then a metallic coupling region 303 is formed by removing the electrode of a first face 100 except a portion between the through holes 101 and 102, and by removing a part of the electrode of the third face 300 except a portion between the input and output electrodes 301 and 302, so that the region 303 would extend from the first face 100 to the third face 300. In the above, the remaining electrode excluding the input and output electrodes 301 and 302 and the metallic coupling region 303 becomes a ground electrode.

Figure 3B:
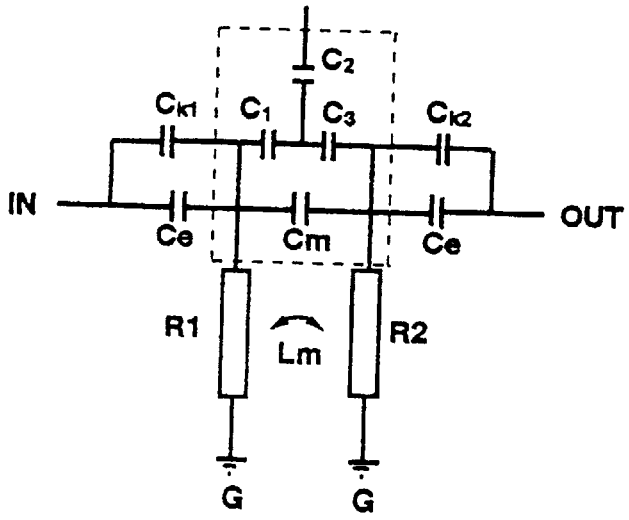
FIG. 3*b* is an equivalent circuit diagram for the dielectric filter of FIG. 3*a;*

This integral type dielectric filter can be expressed by the equivalent circuit diagram of FIG. 3*b*. That is, the metallic coupling region 303 which extends from between the through holes 101 and 102 to between the input and output electrodes 301 and 302 forms capacitances Ck1, Ck2, C1, C2 and C3 between an input terminal IN and an output terminal OUT by the through holes 101 and 102.

Figure 3C:
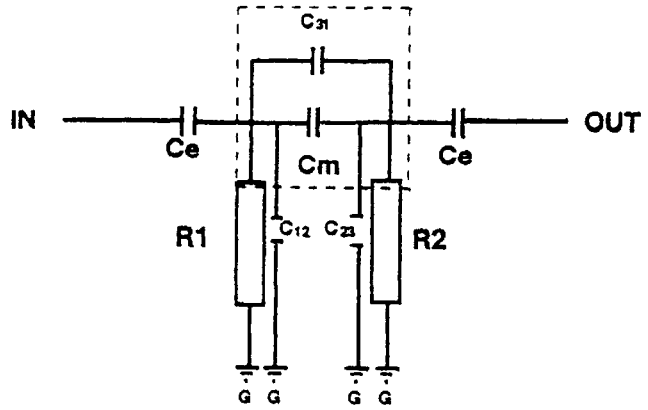
FIG. 3*c* is an equivalent circuit diagram Y-Δ-converted from FIG. 3*b;*

The circuit diagram of FIG. 3*b* can be expressed in the form of the Y-Δ-converted circuit diagram of FIG. 3*c* by omitting Ck1 and Ck2. As the magnitude of the metallic coupling region 303 increases, so much the values of C12, C23 and C31 increase to increase the capacitive coupling, thereby making it possible to augment the damping rate at the low frequency side of the pass band. Consequently, the mean frequency is shifted toward the low frequency side. Therefore, by adjusting the area of the metallic coupling region 303, the electrical coupling can be adjusted.

Figure 1A:
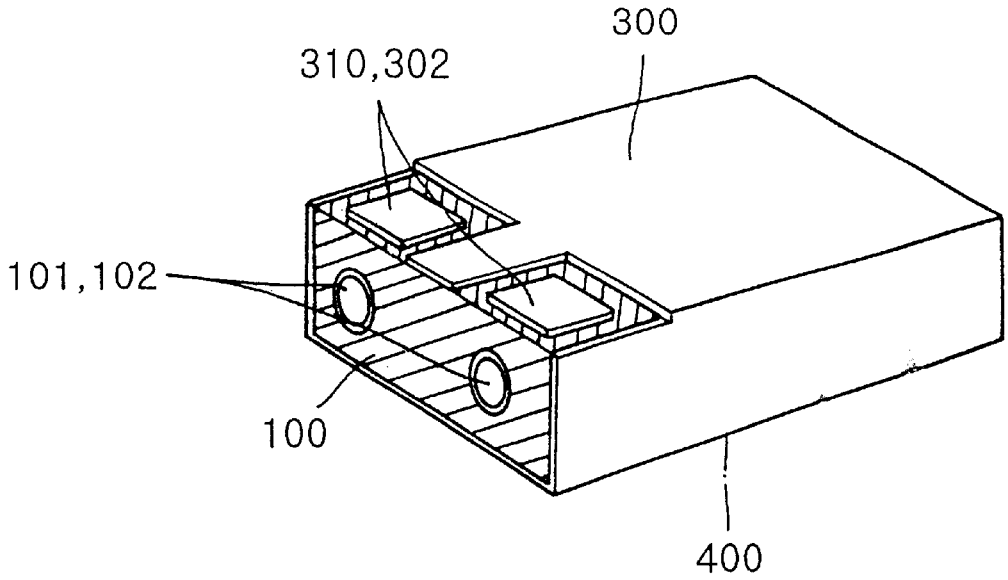
FIG. 1A PRIOR ART
FIG. 1*a* is a perspective view of a conventional integral type dielectric filter.
Figure 1A:
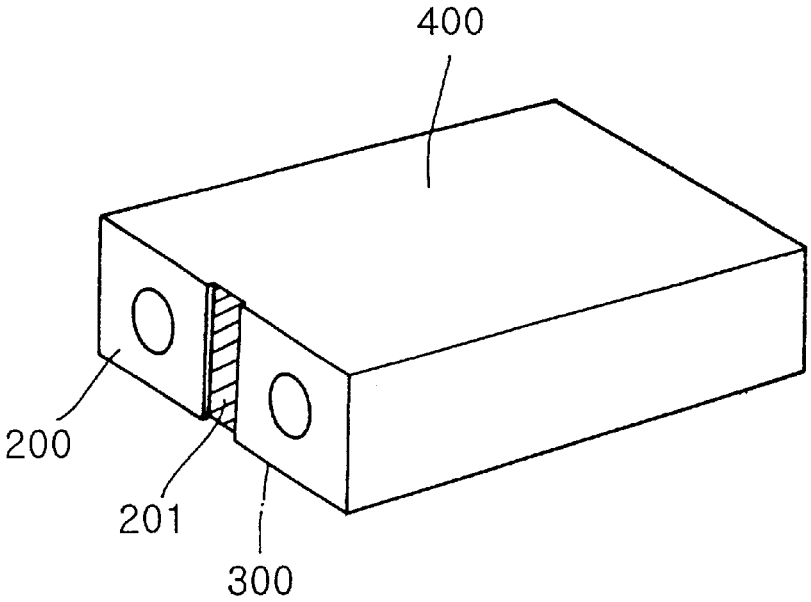
FIG. 1A PRIOR ART
Figure 1B:
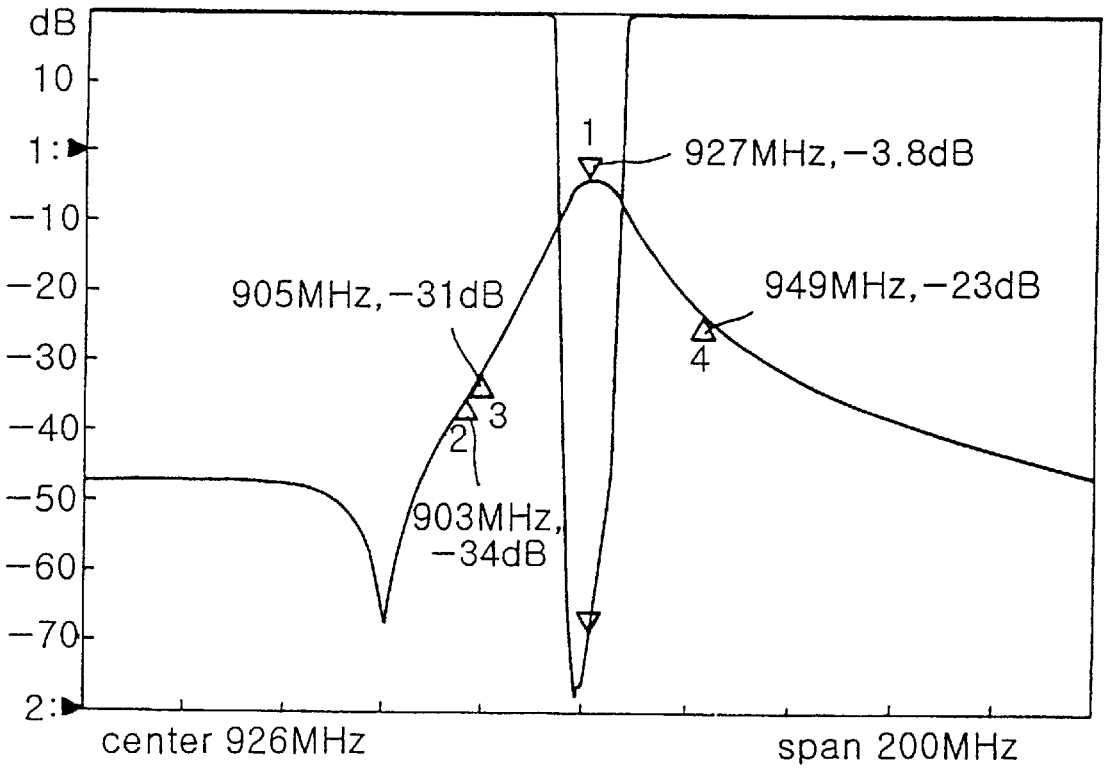
FIG. 1B PRIOR ART
FIG. 1*b* is a graphical illustration showing the characteristics of the dielectric filter of FIG. 1*a;*
Figure 2A:
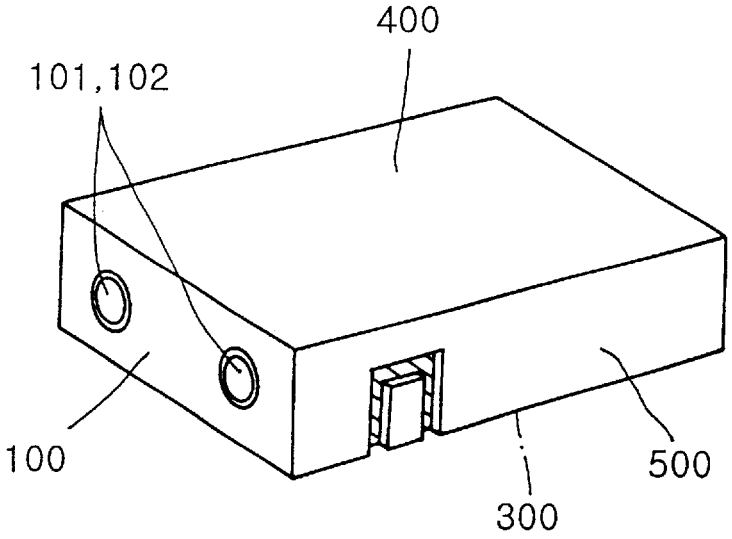
FIG. 2A PRIOR ART
FIG. 2*a* is a perspective view of another conventional integral type dielectric filter.
Figure 2A:
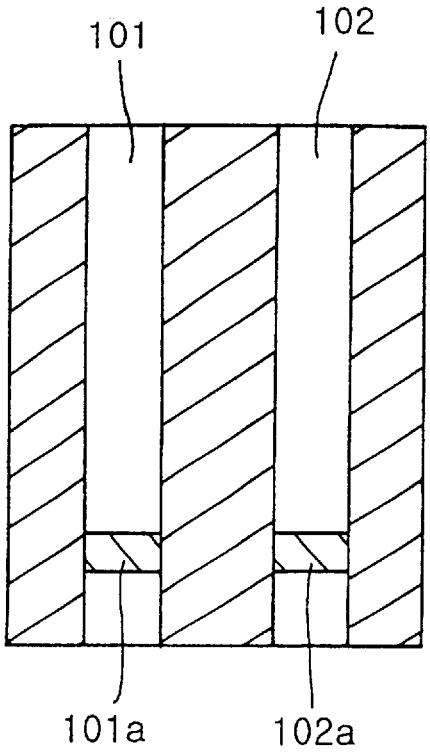
FIG. 2A PRIOR ART
Figure 2B:
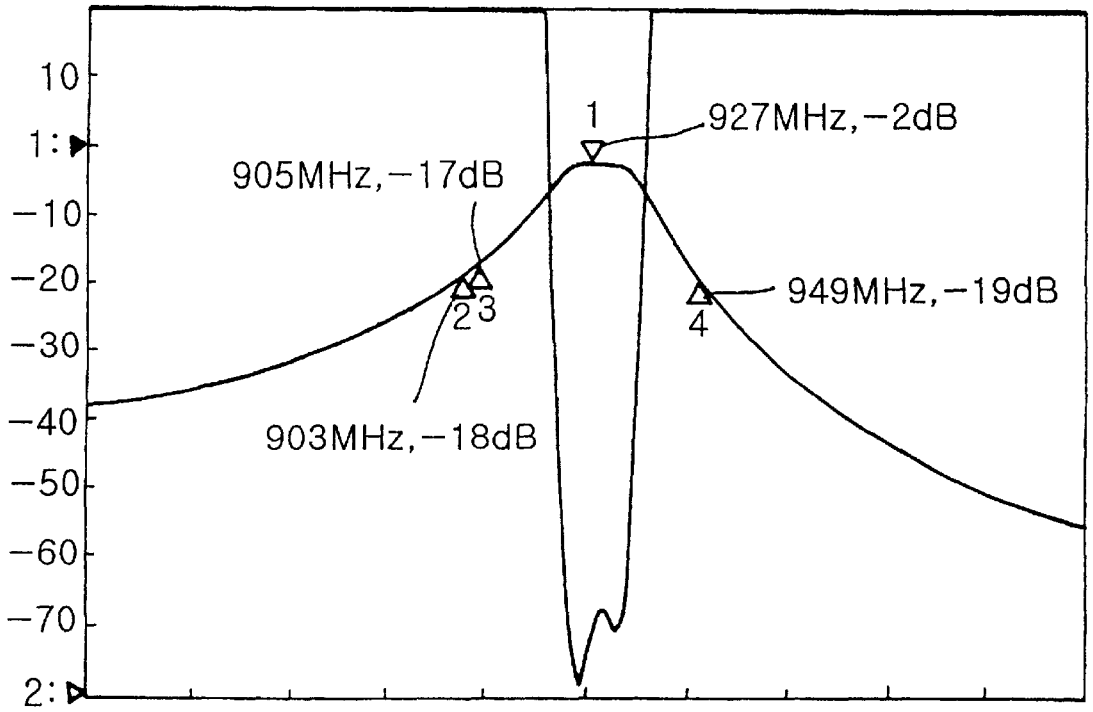
FIG. 2B PRIOR ART
FIG. 2*b* is a graphical illustration showing the characteristics of the dielectric filter of FIG. 2*a;*
Figure 3D:
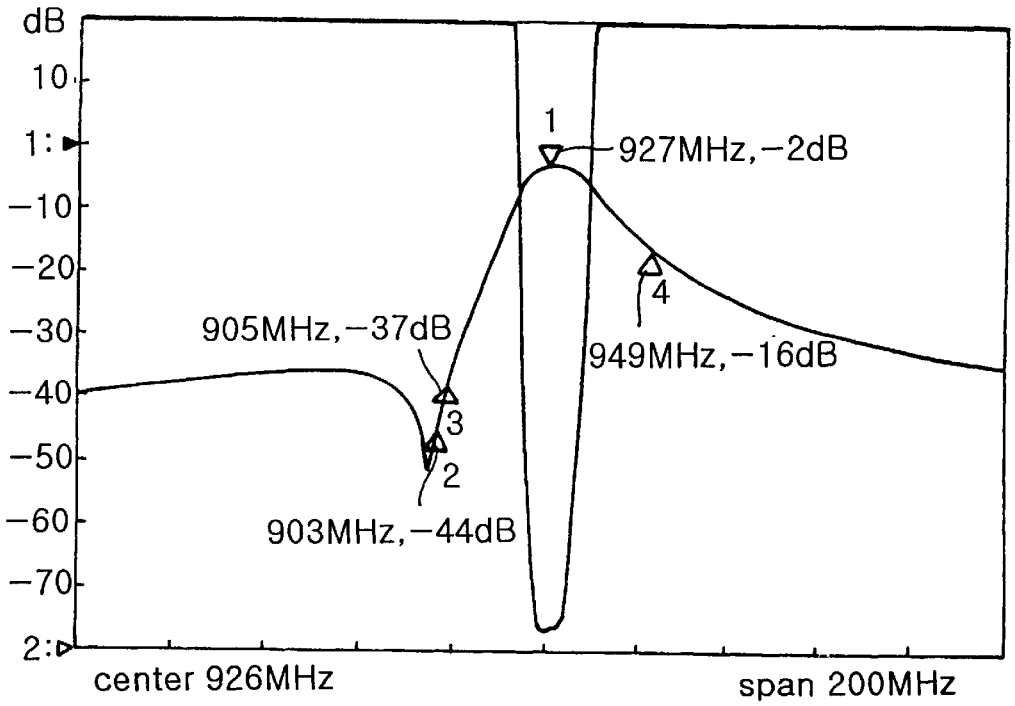
FIG. 3*d* is a graphical illustration showing the characteristics of the dielectric filter of FIG. 3*a;*

For the dielectric filter of FIG. 3*a*, the mean frequency was made to be 927 MHz, and its frequency characteristics were measured. The measured characteristics are illustrated in FIG. 3*d*. As shown in FIG. 3*d*, an insertion loss of about −2.4 dB was seen at the mean frequency of 927 MHz, while at the low frequency side (903 MHz), the insertion loss was decreased to less than −44 dB. Compared with the conventional dielectric filter of FIG. 1*b*, the insertion loss is decreased, and the damping rate at the low frequency side is increased by about 10 dB.

Figure 11:
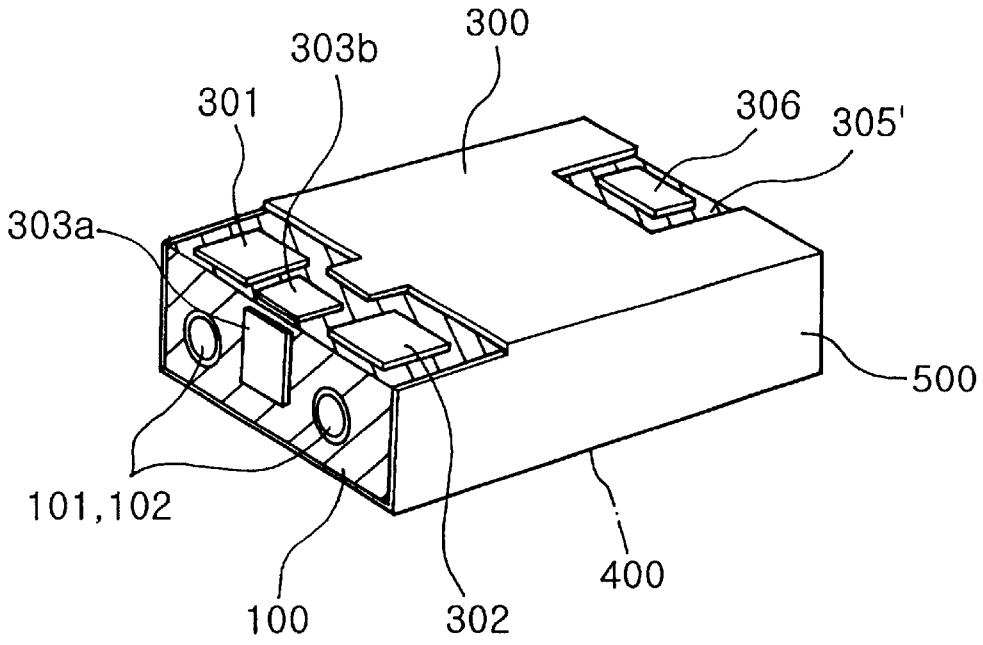
FIG. 11 is a perspective view showing another example of the integral type dielectric filter of FIG. 3*a*.

The metallic coupling region 303 may be divided into a piece on the first face 100 and a piece on the third face 300. Under this condition, as the distance between the two pieces is increased, so much the damping rate is lowered. In general, however, the dielectric block having the through holes is plated with a conductive material, and patterns are printed on the respective faces. In view of this, there is a difficulty in printing the patterns in an exact match between the metallic coupling region of the first face 100 and a metallic coupling region of the third face 300. Therefore, as shown in FIG. 11, a first metallic coupling region 303*a* between the through holes 101 and 102 is formed, and at the same time a second metallic coupling region 303*b* is formed between the input and output electrodes 301 and 302, in such a manner that a gap should be formed at the boundary between the first face 100 and the third face 300. In this manner, the manufacturing is made easier.

Figure 4A:
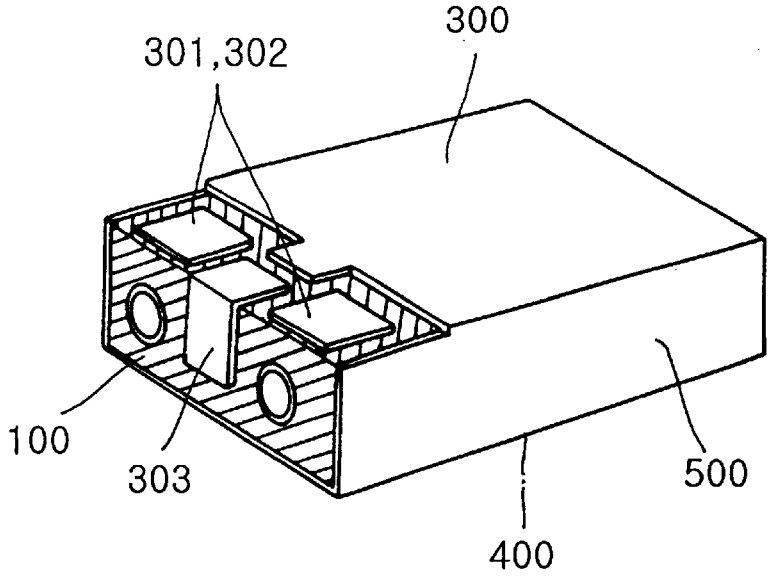
FIG. 4*a* is a perspective view showing another embodiment of the integral type dielectric filter according to the present invention.
Figure 4A:
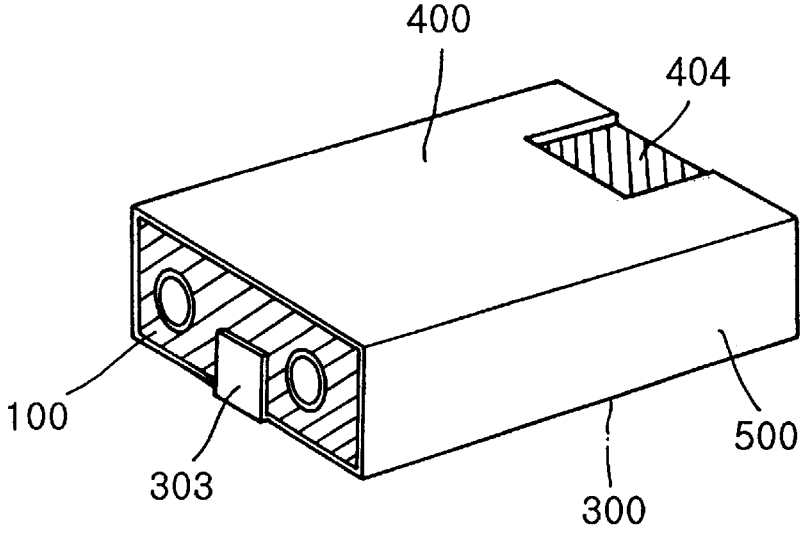

FIG. 4*a* is a perspective view showing another embodiment of the integral type dielectric filter according to the present invention. A conductive electrode is formed on the entire surface of the dielectric block which has through holes 101 and 102 like in FIG. 3*a*. A part of the electrode of a third face 300 which is parallel to the through holes 101 and 102 is removed to form input and output electrodes 301 and 302. Then a metallic coupling region 303 is formed by removing the electrode of the first face 100 except a portion between the through holes 101 and 102, and by removing a part of the electrode of the third face 300 except a portion between the input and output electrodes 301 and 302, so that the region 303 would extend from the first face 100 to the third face 300. Then a portion (remote from the first face 100) of a fourth face 400 which faces toward the third face 300 is removed, thereby forming a non-metallic coupling region 404. Thus an inductive coupling is formed.

In the above, as the position of the non-metallic coupling region 404 of the fourth face 400 is biased toward a second face 200, so much the inductive coupling is reinforced.

In the dielectric filter of FIG. 4*a*, the inductive coupling is reinforced by the non-metallic coupling region 404 of the fourth face 400, and therefore, the damping characteristics at the high frequency side are improved.

Figure 4B:
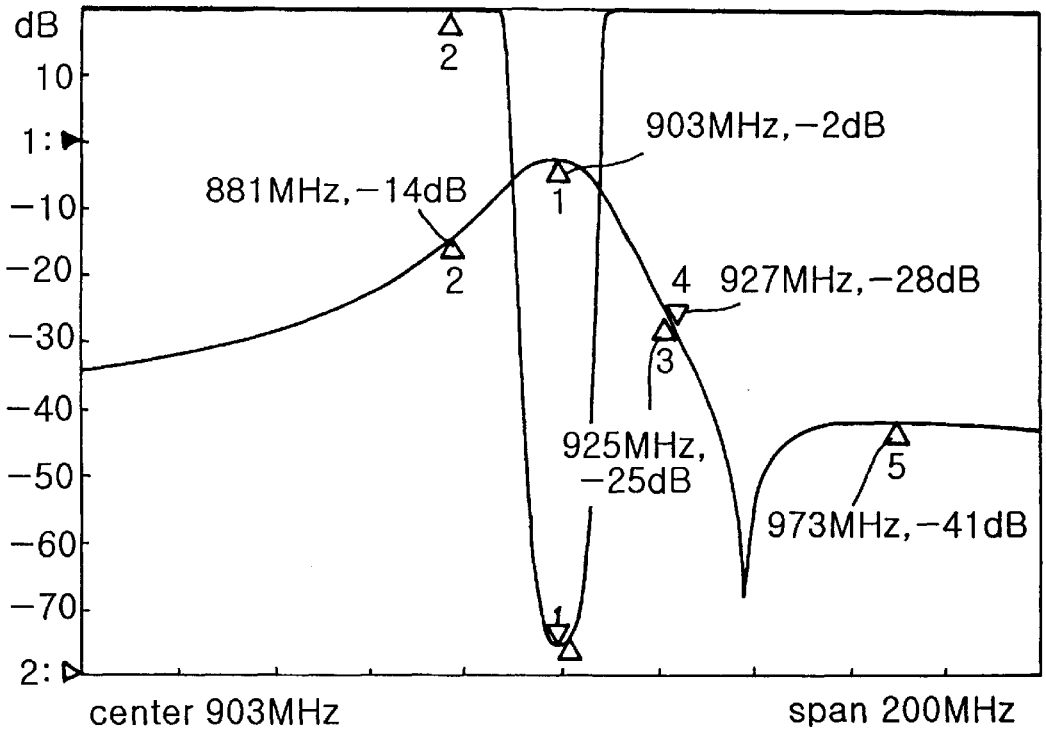
FIG. 4*b* is a graphical illustration showing the characteristics of the dielectric filter of FIG. 4*a;*

FIG. 4*b* is a graphical illustration showing the characteristics of the dielectric filter of FIG. 4*a*. Here, a dielectric block having a mean frequency of 903 MHz was subjected to the measurement of its frequency characteristics. Here, a capacitive coupling is formed by the metallic coupling region 303, and the inductive coupling is reinforced by the nonmetallic coupling region 404. That is, in order to improve the damping characteristics of the high frequency side nearer to the mean frequency, there is formed a capacitive filter in which the damping characteristics are superior in the low frequency side as shown in FIG. 3*a*. Then the non-metallic coupling region 404 is added to the filter of FIG. 3*a*, and in this manner, the inductive coupling is reinforced. In this case, there are obtained the characteristics which are opposite to those of FIG. 3*b*. That is, as shown in FIG. 4*b*, a damping rate of −28 dB is seen in the high frequency band (927 MHz). Under this condition, the insertion loss is −2 dB at the mean frequency, and thus the insertion loss is decreased compared with that of the conventional dielectric filters.

In the above, if the notch point of the high frequency side is to be made nearer to the mean frequency, the capacitive coupling has only to be increased. However, if the damping characteristics of the high frequency band is increased, then the damping characteristics of the low frequency band is decreased. Therefore, the notch point can be made nearer to the mean frequency by adjusting the areas of the non-metallic coupling region 404 and the metallic coupling region 303. In this manner, the desired damping characteristics can be obtained within the range of a proper insertion loss.

Further, when the dielectric filter of FIG. 3*a* or 4*a* is installed on a circuit board PCB, the ground electrode of the circuit board which contacts with the metallic coupling region 303 should be removed, or the region 303 should be isolated from the circuit board by a soldering resist.

Figure 5:
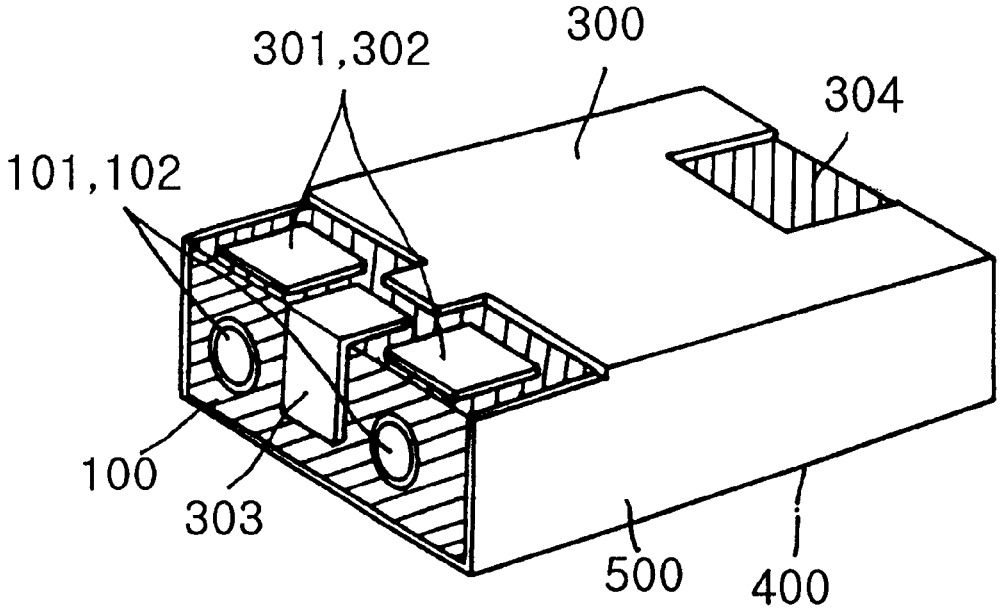
FIG. 5 is a perspective view showing still another embodiment of the integral type dielectric filter according to the present invention, it having the same characteristics as those of FIG. 4*a;*
Figure 6:
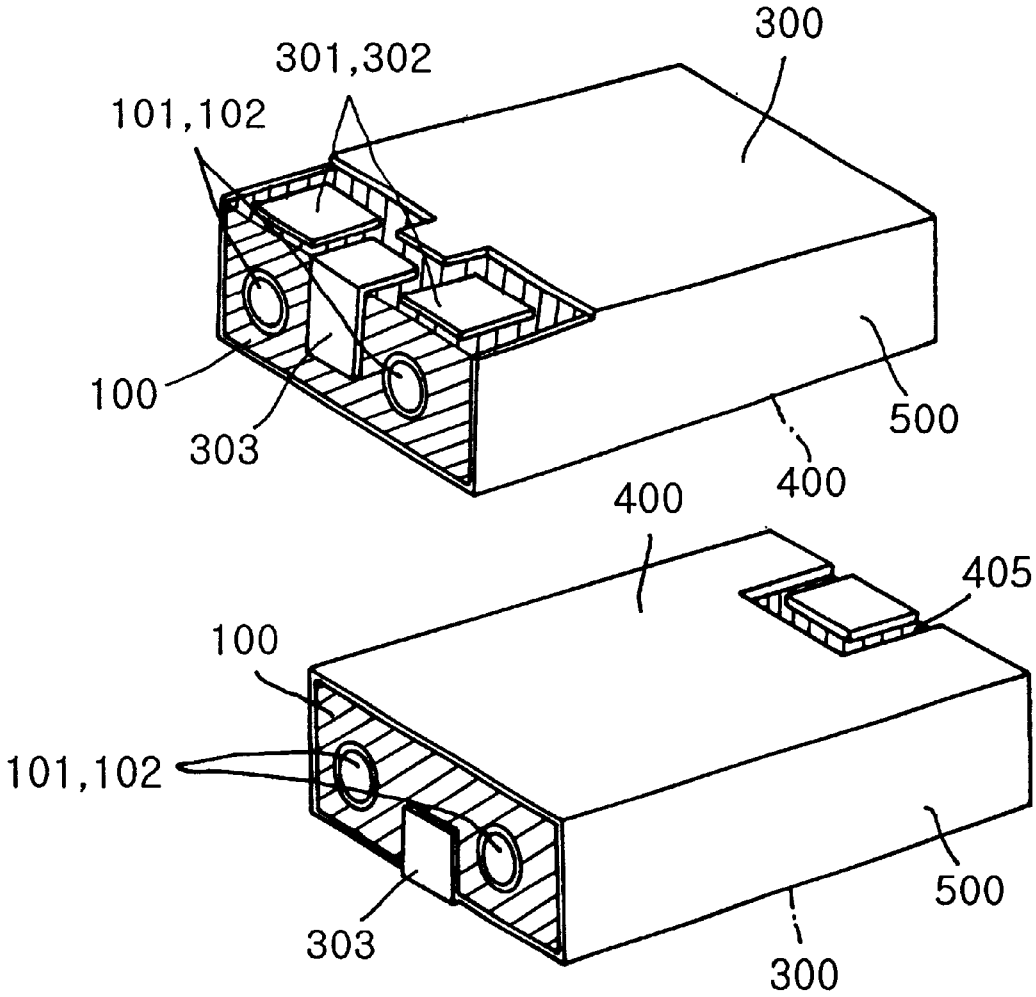
FIG. 6 is a perspective view showing still another embodiment of the integral type dielectric filter according to the present invention, it having the same characteristics as those of FIG. 4*a;*

Other embodiments of the dielectric filter are illustrated in FIGS. 5–7, and this filters have characteristics same as those of FIG. 4*a*. Referring to FIG. 5, a non-metallic coupling region 304 is formed on the third face 300 on which the input and output electrodes 301 and 302 and the metallic coupling region 303 are formed. This structure simplifies the printing steps, thereby making it easier to manufacture the dielectric filter.

Referring to FIG. 6, a non-metallic coupling line 405 is formed on the fourth face 400 instead of the non-metallic coupling region 404. Even with this non-metallic coupling line, the desired effects can be obtained.

Figure 7A:
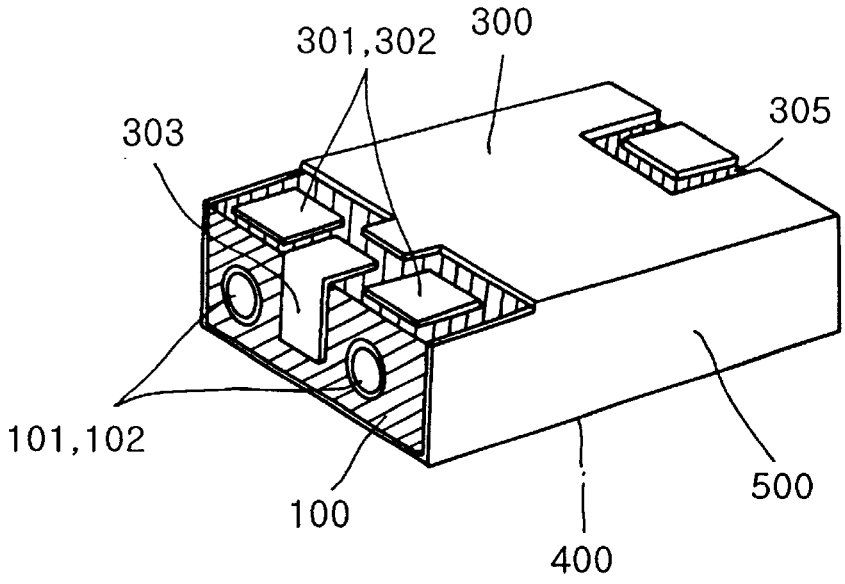
FIGS. 7*a* and 7*b* are perspective views showing still other embodiments of the integral type dielectric filter according to the present invention, they having the same characteristics as those of FIG. 4*a;*

Referring to FIG. 7*a*, a non-metallic coupling line 305 is formed on the third face 300 on which the input and output electrodes 301 and 302 and a part of the metallic coupling region 303 are formed. Even if the contour of the non-metallic regions are varied on the third face 300, the same insertion loss and the same damping rate can be obtained. Like the embodiment of FIG. 5, this embodiment simplifies the printing steps so as to facilitate the production.

Figure 7B:
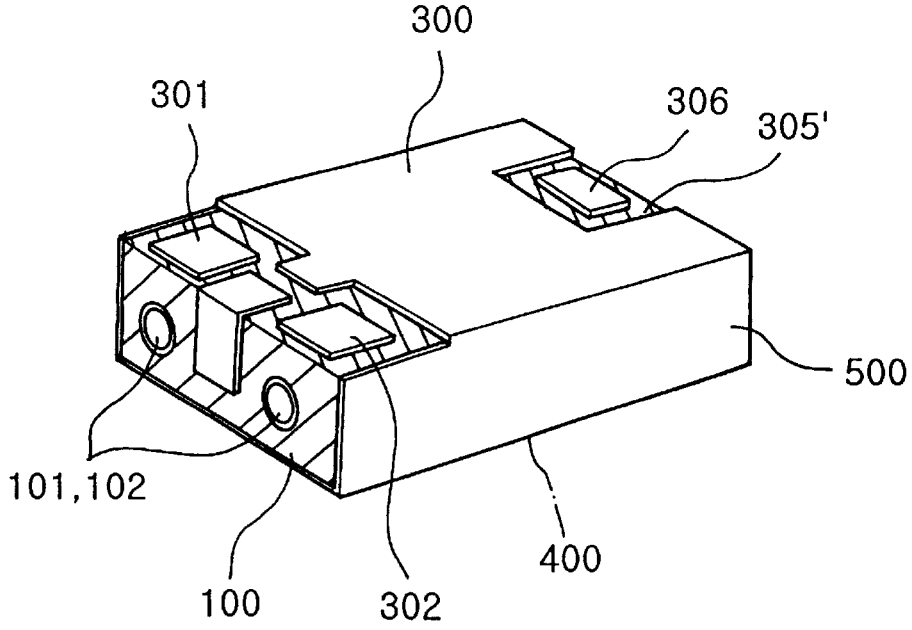

Referring to FIG. 7*b*, a non-metallic coupling region 305' is formed on the third face 300 in the shape of a closed loop, and an electrode region 306 is formed by the non-metallic coupling region 305', the electrode region 306 being insulated from the ground electrode. With this arrangement also, the damping rate at the high frequency side can be improved.

Figure 8:
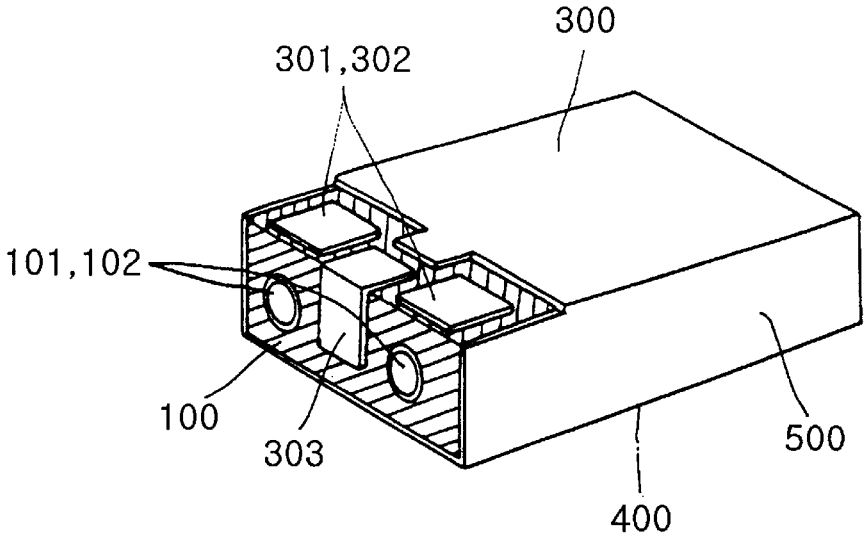
FIG. 8 is a perspective view showing still another embodiment of the integral type dielectric filter according to the present invention, it forming an inductive coupling filter.
Figure 8:
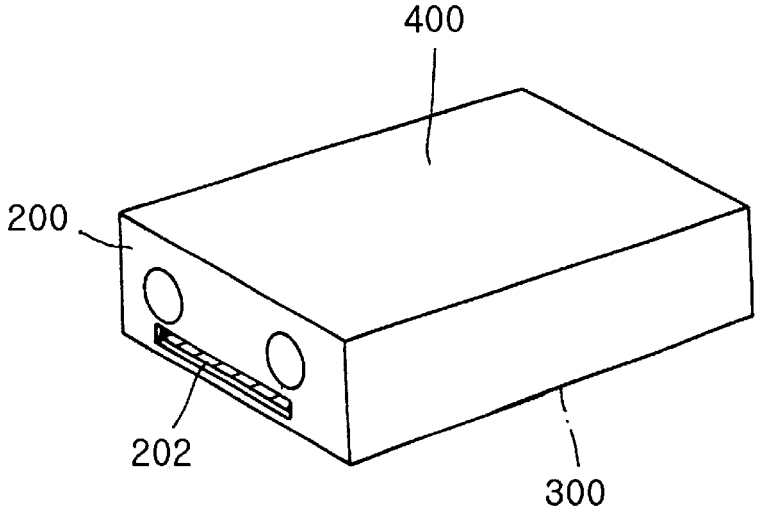

FIG. 8 illustrates still another embodiment of the dielectric filter of the present invention. That is, through holes 101 and 102 are formed in a dielectric block in which the capacitive coupling is formed like in FIG. 4*a*. Further, a non-metallic coupling region 202 is formed on the second face 200 in a shape of a straight line and in parallel with the arrangement direction of the through holes 101 and 102, the second face 200 lying opposite to the first face 100 in which the entire area of the electrode is removed except the metallic coupling region 303. In this manner, the inductive coupling is reinforced. In this embodiment also, the damping characteristics at the high frequency band are improved together with almost zero insertion loss. In this dielectric filter, when installing to an apparatus set, the magnitude of the shielding by the casing of the apparatus set can be minimized, so that the coupling of the magnetic field of the non-metallic coupling region 202 can be shielded. Accordingly, the dielectric filter of FIG. 8 maintains stable characteristics after being installed to the apparatus set.

Figure 9:
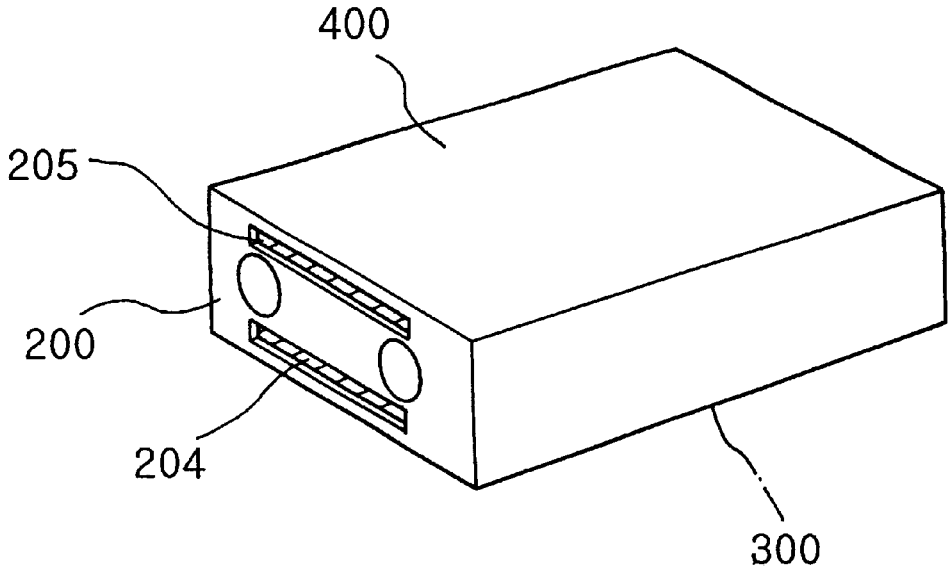
FIG. 9 is a perspective view showing another example of the integral type dielectric filter of FIG. 8.

The non-metallic coupling region 202 can be formed in the number of two or more as shown in FIG. 9. As the lengths of the non-metallic coupling regions are extended, so much the inductive coupling is increased. Therefore, when making a wide band pass filter, two non-metallic coupling regions 204 and 205 are formed below and above the through holes in parallel with the arrangement direction of them.

When forming the non-metallic coupling region on the second face, the third face or the fourth face, there may be formed corrugations on the edges of the non-metallic coupling region, thereby making it possible to adjust the tuning frequency.

This kind of structure is illustrated in FIG. 10.

Figure 10A:
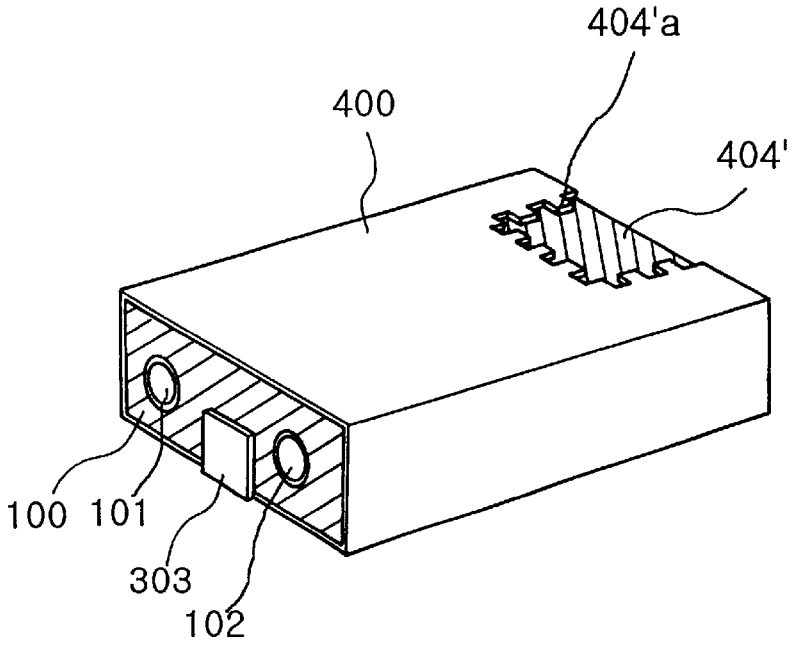
FIGS. 10*a* and 10*b* are perspective views showing still another embodiment of the integral type dielectric filter according to the present invention, in which adjustments of the tuning frequency is possible.
Figure 10B:
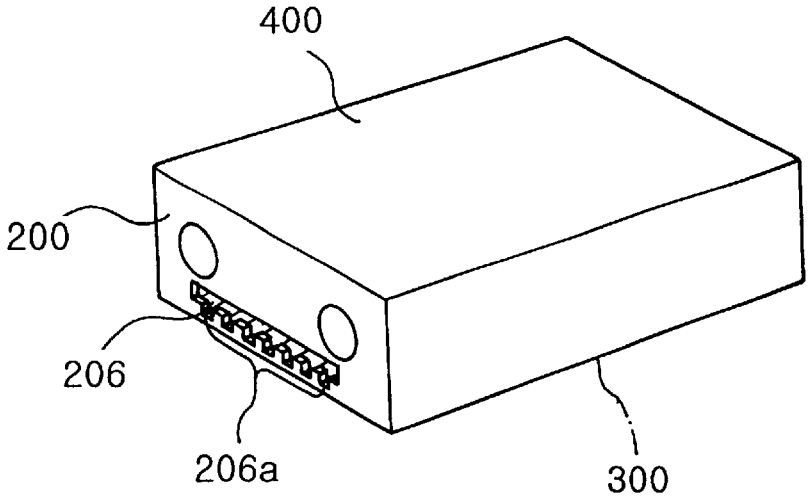

Referring to FIG. 10*a*, corrugations are added to the non-metallic coupling region 404 of FIG. 4*a*, thereby forming a non-metallic coupling region 404'. Thus it is made possible to adjust the tuning frequency. Referring to FIG. 10*b*, the non-metallic coupling region 202 of the second face of the filter of FIG. 8 is provided in the shape of saw teeth, so as to form a non-metallic coupling region 206. In this dielectric filter, the tuning frequency can be adjusted by properly removing the metallic electrodes within the saw teeth or the corrugations 206*a* or 404*a'* of the non-metallic coupling region 404 or 206.

According to the present invention as described above, the patterns of the plated layer of the dielectric block are varied, so that the damping characteristics can be satisfied up to −35 dB, and that the insertion loss can be maintained down to −2.5 dB. Thus the insertion loss can be decreased compared with the conventional techniques. Further, in the case of the inductive coupling filter, the insertion loss can be decreased compared with the conventional cases, and the damping characteristics can be improved.

What is claimed is:

1. An integral dielectric filter comprising:

a dielectric block having first and second end faces and a plurality of side faces extending between said end faces;

a ground electrode coated on said second and side faces of said dielectric block;

a plurality of through holes passing through said first end face and said second end face, with the surfaces of the through holes being coated with a conductive material to form internal electrodes;

input and output electrodes formed on one of said side faces of said dielectric block insulatingly from said ground electrode, for forming an electromagnetic coupling with said internal electrodes of the plurality of said through holes; and at least one metallic coupling region formed on said one of said side faces between said input and output electrodes and on said first end face between said through holes insulatingly from said ground electrode and from said input and output electrodes to form a capacitive coupling between said input and output electrodes and said through holes.

2. The integral dielectric filter as claimed in claim 1, wherein said metallic coupling region lies partly between said through holes and partly between said input and output electrodes.

3. The integral dielectric filter as claimed in claim 1, wherein said metallic coupling region consists of a first metallic region positioned between said input and output electrodes and insulated from other electrodes, and a second metallic region positioned between said through holes and insulated from other electrodes.

4. An integral dielectric filter comprising:

a dielectric block having first and second end faces and a plurality of side faces extending between said end faces;

a ground electrode coated on said second and side faces of said dielectric block;

a plurality of through holes passing through said first end face and said second end face, with the surfaces of the through holes being coated with a conductive material to form internal electrodes;

input and output electrodes formed on one of said side faces of said dielectric block insulatingly from said ground electrode, for forming an electromagnetic coupling with said internal electrodes of the plurality of said through holes;

at least one metallic coupling region formed on said one of said side faces between said input and output electrodes and on said first end face between said through holes insulatingly from said ground electrode and from said input and output electrodes to form a capacitive coupling between said input and output electrodes and said through holes; and at least a non-metallic coupling region formed on one of the side faces at a location closer to said second end face than said first end face, for forming an inductive coupling with a plurality of said plurality of through holes.

5. The integral dielectric filter as claimed in claim 4, wherein said non-metallic coupling region and said input and output electrodes lie on the same one of said side faces.

6. The integral dielectric filter as claimed in claim 4, wherein said non-metallic coupling region lies on a side face opposite to that of said input and output electrodes.

7. The integral dielectric filter as claimed in claim 4, wherein said non-metallic coupling region is rectangular.

8. The integral dielectric filter as claimed in claim 4, wherein said non-metallic coupling region is linear.

9. The integral dielectric filter as claimed in claim 4, wherein said non-metallic coupling region is U-shaped.

10. The integral dielectric filter as claimed in claim 4, wherein said non-metallic coupling region has corrugations on its edges to make it possible to adjust a tuning frequency.

11. An integral dielectric filter comprising:

a dielectric block having first and second end faces and a plurality of side faces extending between said end faces;

a ground electrode coated on said second and side faces of said dielectric block;

a plurality of through holes passing through said first end face and said second end face, with the surfaces of the through holes being coated with a conductive material to form internal electrodes;

input and output electrodes formed on one of said side faces of said dielectric block insulatingly from said ground electrode, for forming an electromagnetic coupling with said internal electrodes of the plurality of said through holes;

at least one metallic coupling region formed on said one of said side faces between said input and output electrodes and on said first end face between said through holes insulatingly from said ground electrode and from said input and output electrodes to form a capacitive coupling between said input and output electrodes and said through holes;

at least one non-metallic coupling region surrounding a metallic region on one of said side faces, and said metallic region being insulated from said ground electrode by said non-metallic coupling region.

12. The integral dielectric filter as claimed in claim 11, wherein said non-metallic coupling region and said input and output electrodes lie on the same side face.

13. The integral dielectric filter as claimed in claim 11, wherein said non-metallic coupling region lies on a side face opposite to that of said input and output electrodes.

14. The integral dielectric filter as claimed in claim 11, wherein said non-metallic coupling region is of a closed rectangular loop.

15. The integral dielectric filter as claimed in claim 11, wherein said non-metallic coupling region has corrugations on its edges to make it possible to adjust a tuning frequency.

16. An integral dielectric filter comprising:

a dielectric block having first and second end faces and a plurality of side faces extending between said end faces;

a ground electrode coated on said second and side faces of said dielectric block;

a plurality of through holes passing through said first end face and said second end face, with the surfaces of the through holes being coated with a conductive material to form internal electrodes;

input and output electrodes formed on one of said side faces of said dielectric block insulatingly from said ground electrode, for forming an electromagnetic coupling with said internal electrodes of the plurality of said through holes;

at least one metallic coupling region formed on said one of said side faces between said input and output electrodes and on said first end face between said through holes insulatingly from said ground electrode and from said input and output electrodes to form a capacitive coupling between said input and output electrodes and said through holes; and at least one non-metallic coupling region formed along an arrangement direction of the plurality of said through holes, for forming an inductive coupling between the plurality of said through holes.

17. The integral dielectric filter as claimed in claim 16, wherein said non-metallic coupling region is linear, has a required length, and is an open region formed along an arrangement direction of said through holes such that said open region is between said through holes and an adjacent one of said plurality of side faces.

18. The integral dielectric filter as claimed in claim 16, wherein the at least one non-metallic coupling region includes a first non-metallic coupling region and a second non-metallic coupling region, said through holes being located between said first non-metallic coupling region and said second non-metallic coupling region so as to form two open regions.

19. The integral dielectric filter as claimed in claim 16, wherein said non-metallic coupling region has corrugations on its edges to make it possible to adjust a tuning frequency.

* * * * *